US012303798B2

(12) United States Patent
Sall et al.

(10) Patent No.: US 12,303,798 B2
(45) Date of Patent: May 20, 2025

(54) INTERACTIVE RAFT RIDE

(71) Applicant: WHITEWATER WEST INDUSTRIES, LTD., Richmond (CA)

(72) Inventors: Kelly Sall, Richmond (CA); Rick Briggs, Springfield, IL (US); Mark Weston, Wakefield, RI (US)

(73) Assignee: WHITEWATER WEST INDUSTRIES, LTD., Richmond (CA)

( * ) Notice: Subject to any disclaimer, the term of this patent is extended or adjusted under 35 U.S.C. 154(b) by 0 days.

(21) Appl. No.: 17/935,549

(22) Filed: Sep. 26, 2022

(65) Prior Publication Data

US 2023/0173397 A1 Jun. 8, 2023

Related U.S. Application Data

(63) Continuation of application No. 16/431,567, filed on Jun. 4, 2019, now Pat. No. 11,498,008.

(60) Provisional application No. 62/680,563, filed on Jun. 4, 2018.

(51) Int. Cl.
*A63G 3/02* (2006.01)
*A63G 5/00* (2006.01)

(52) U.S. Cl.
CPC *A63G 3/02* (2013.01); *A63G 5/00* (2013.01)

(58) Field of Classification Search
CPC ... A63G 1/04; A63G 3/00; A63G 3/02; A63G 7/00; A63G 31/00; A63G 31/007
USPC ..... 472/1, 116–117, 128; 114/345; 463/7, 463/52, 53
See application file for complete search history.

(56) References Cited

U.S. PATENT DOCUMENTS

| | | | |
|---|---|---|---|
| 1,648,196 | A | 11/1927 | Rohmer |
| 2,058,383 | A | 10/1936 | Maynes |
| 3,497,211 | A | 2/1970 | Nagin et al. |
| 3,539,181 | A | 11/1970 | Larsen et al. |
| D229,354 | S | 11/1973 | Morgan |
| 3,871,042 | A | 3/1975 | Farmer |
| 4,057,244 | A | 11/1977 | Gaspar |
| 4,145,042 | A | 3/1979 | Becker et al. |
| 4,149,710 | A | 4/1979 | Rouchard |
| 4,194,733 | A | 3/1980 | Whitehouse, Jr. |

(Continued)

OTHER PUBLICATIONS

Non-Final Office Action for U.S. Appl. No. 16/431,567, dated Jan. 21, 2022, 8 pages.

(Continued)

*Primary Examiner* — Kien T Nguyen
(74) *Attorney, Agent, or Firm* — Buchalter, a Professional Corporation

(57) ABSTRACT

A water ride includes ride vehicles and spectator areas for allowing interaction between ride vehicles and/or between a ride vehicle and spectators to the ride. The water ride may include engagement components (e.g., water guns) located on the ride vehicle and/or at spectator areas. Users of the engagement components may therefore interact with other users operating other engagement components. Activators and corresponding reactors may be triggered by users and/or automatically providing additional entertainment and interaction for the water ride. Various charging capabilities may be used for powering one or more components, activators, and/or reactors of the ride, ride vehicle, and/or spectator areas.

20 Claims, 5 Drawing Sheets

(56) References Cited

U.S. PATENT DOCUMENTS

| | | | | |
|---|---|---|---|---|
| 4,196,900 | A | 4/1980 | Becker et al. | |
| 4,205,785 | A | 6/1980 | Stanley | |
| 4,506,664 | A | 3/1985 | Brault | |
| 4,573,679 | A | 3/1986 | Janszen | |
| 4,799,665 | A | 1/1989 | Bracy | |
| 4,805,897 | A | 2/1989 | Dubeta | |
| 4,805,898 | A | 2/1989 | Jacober et al. | |
| 4,811,682 | A * | 3/1989 | Hwang | B63B 34/52 114/345 |
| 5,011,134 | A | 4/1991 | Langford | |
| D331,439 | S | 12/1992 | Gibson | |
| 5,194,048 | A | 3/1993 | Briggs | |
| 5,213,547 | A | 5/1993 | Lochtefeld | |
| 5,288,071 | A | 2/1994 | Solomon | |
| 5,378,197 | A | 1/1995 | Briggs | |
| 5,405,294 | A | 4/1995 | Briggs | |
| 5,453,054 | A | 9/1995 | Langford | |
| 5,662,525 | A | 9/1997 | Briggs | |
| 5,685,778 | A | 11/1997 | Sheldon et al. | |
| 5,716,281 | A | 2/1998 | Dote | |
| 5,785,592 | A * | 7/1998 | Jacobsen | A63F 13/28 463/52 |
| 5,820,471 | A | 10/1998 | Briggs | |
| 5,853,332 | A | 12/1998 | Briggs | |
| 6,115,974 | A * | 9/2000 | Milanian | B63B 13/00 472/136 |
| 6,132,318 | A | 10/2000 | Briggs | |
| 6,186,902 | B1 | 2/2001 | Briggs | |
| 6,210,287 | B1 | 4/2001 | Briggs | |
| 6,220,965 | B1 | 4/2001 | Hanna et al. | |
| 6,261,186 | B1 * | 7/2001 | Henry | A63G 31/007 239/16 |
| 6,334,799 | B1 | 1/2002 | Delpozo et al. | |
| 6,375,578 | B1 | 4/2002 | Briggs | |
| 6,527,646 | B1 | 3/2003 | Briggs | |
| 6,746,334 | B1 * | 6/2004 | Barney | A63G 31/00 273/349 |
| 6,762,586 | B2 | 7/2004 | Choi | |
| 6,773,355 | B1 * | 8/2004 | Lekhtman | B63B 35/44 472/129 |
| 6,871,368 | B2 | 3/2005 | Calkin | |
| 7,267,586 | B1 | 9/2007 | Murphy | |
| 7,530,321 | B2 | 5/2009 | Dingel et al. | |
| 7,758,435 | B2 | 7/2010 | Henry et al. | |
| 7,896,742 | B2 | 3/2011 | Weston et al. | |
| 7,905,790 | B2 | 3/2011 | Schnuckle | |
| 7,927,175 | B2 * | 4/2011 | Coffey | F41B 9/0021 446/153 |
| 7,967,682 | B2 | 6/2011 | Huizinga | |
| 7,967,692 | B2 | 6/2011 | Werner | |
| 8,226,293 | B2 | 7/2012 | Faries, Jr. et al. | |
| 8,545,284 | B2 | 10/2013 | Baarman et al. | |
| D693,741 | S | 11/2013 | Carrier | |
| 9,138,653 | B2 | 9/2015 | Heaven et al. | |
| 9,387,408 | B2 | 7/2016 | Mendelson et al. | |
| 9,486,711 | B2 | 11/2016 | Brassard et al. | |
| 9,592,454 | B2 | 3/2017 | Weston et al. | |
| 9,764,245 | B2 | 9/2017 | Weston et al. | |
| 11,498,008 | B2 | 11/2022 | Sall et al. | |
| 2004/0090206 | A1 | 5/2004 | Choi | |
| 2008/0293470 | A1 | 11/2008 | Proud et al. | |
| 2013/0244801 | A1 * | 9/2013 | Frolov | A63G 3/02 472/61 |
| 2014/0057524 | A1 | 2/2014 | Teel et al. | |
| 2016/0184718 | A1 | 6/2016 | Briggs et al. | |
| 2018/0041053 | A1 | 2/2018 | Capizzo | |
| 2018/0284881 | A1 | 10/2018 | Briggs et al. | |
| 2019/0176026 | A1 | 6/2019 | Briggs | |
| 2019/0366223 | A1 | 12/2019 | Sall et al. | |

OTHER PUBLICATIONS

Notice of Allowance for U.S. Appl. No. 16/431,567, dated Jun. 24, 2022, 8 pages.

Supplemental Notice of Allowance for U.S. Appl. No. 16/431,567, dated Oct. 18, 2022, 5 pages.

Final Office Action for U.S. Appl. No. 16/431,567, dated May 8, 2020, 8 pages.

Non-Final Office Action for U.S. Appl. No. 16/431,567, dated Nov. 1, 2019, 8 pages.

Notice of Allowance for U.S. Appl. No. 16/431,567, dated Jul. 27, 2020, 13 pages.

Notice of Allowance for U.S. Appl. No. 16/431,567, dated Nov. 6, 2020, 9 pgs.

Notice of Allowance for U.S. Appl. No. 16/431,567, dated Mar. 2, 2021, 11 pages.

* cited by examiner

INTERACTIVE RAFT RIDE

CROSS REFERENCE TO RELATED APPLICATIONS

This application claims the benefit of U.S. Provisional Patent Application Ser. No. 62/680,563, filed on Jun. 4, 2018, entitled "INTERACTIVE RAFT RIDE," which is hereby incorporated by reference in its entirety into this application.

BACKGROUND

Field of the Invention

The present invention relates to a method, system, and/or apparatus for entertaining users in an amusement ride. More particularly, the present invention relates to a method, system, or apparatus for allowing interactivity between a first ride vehicle or users of the first ride vehicle and another, second ride vehicle or users not associated with the first ride vehicle while on art amusement ride, such as a water ride.

Description of the Related Art

Entertainment attractions, such as amusement rides or water rides, have become a popular entertainment activity around the world. In one type of conventional amusement ride, users sit in a ride vehicle as the ride vehicle traverses a track or other pathway. In some conventional amusement rides, such as water-based attractions, one or more users may sit in a ride vehicle as the ride vehicle floats or is otherwise at least partially submerged within a flow or body of water. Some entertainment attractions include a vehicle that is affixed to and moves along a predetermined path. This predetermined path leads to fixed and repetitive movement of the vehicle. This can lead to a lessening of the entertainment experienced by users, as users may find the entertainment attraction predictable. Additionally, the predetermined path usually includes a fixed track or trail. These fixed tracks and trails therefore cannot be changed readily to provide different sensations to users. Therefore, users may tend to avoid revisiting the same entertainment attraction. Conventional entertainment attractions also provide entertainment to users of the entertainment attraction. Typically, any entertainment value to spectators is very limited, derived by viewing users on the ride. As such, conventional entertainment attractions do not provide a way for spectators to interact with the entertainment attraction or the users of the entertainment attraction.

Accordingly, an improved method, system, and or apparatus is desired for addressing one or more of the problems identified above and/or to aid in permitting one or more users, either upon an entertainment attraction or spectating an entertainment attraction to engage is increased interactivity with the entertainment attraction.

SUMMARY

Exemplary embodiments described herein include entertainment attractions that allow for a dynamically moving vehicle and/or allow for interaction between users of the entertainment attractions and spectators thereto.

In one embodiment, an entertainment attraction may include ride vehicles (e.g., rafts, boats, etc.) that are permitted to float freely or substantially freely within a body of water, for example, within tracks disposed within the water.

The ride vehicles may not be affixed to the tracks. The ride vehicles may be permitted to laterally, longitudinally, and/or any combination thereof travel within the tracks in the body of water. The ride vehicles may also be permitted to rotate within the water. Various number of users may be carried by the ride vehicles in differing embodiments. The entertainment attraction may incorporate sidewalls (e.g., in addition to the tracks and/or as an alternative to the tracks) to help prevent the ride vehicles from leaving the area between the tracks.

Adjacent to the entertainment attraction (e.g., along a shore or other area adjacent to the body of water), one or more spectators may watch and/or participate or interact with users and/or the ride vehicles of the entertainment attraction. In one embodiment, the entertainment attraction may include one or more engagement components (e.g., located upon a ride vehicle, on or near the shore, or any of a variety of other locations associated with the entertainment attraction, or any combination thereof). The engagement components may be configured to project a fluid (e.g., water) outwardly. As such, the engagement components may be, but are not limited to, water guns, water cannons, and/or any combination thereof. The engagement components located on a ride vehicle may project water away from an interior of the ride vehicle (e.g., may be directed toward spectators watching the entertainment attraction). The engagement components located on the shores adjacent to the body of water may project water towards an interior of the entertainment attraction (e.g., may be directed toward users or ride vehicles participating on the entertainment attraction).

The entertainment attraction or water ride may also include one or more activators. The activators may couple with one or more reactors. The activators may cause an action in the one or more reactors when triggered. For example, in one embodiment, the activators may be triggered via one or more of the engagement components located throughout the attraction and/or adjacent to the attraction, such as by detecting or sensing when a stream of water makes contact with the activator, when a light or laser makes contact with the activator, etc.). The activators may be coupled to the reactors through the following non-limiting examples: wireless connections, wired connections, mechanical connections, and/or any combination thereof. The activators may include, but are not limited to, targets, buttons, switches, knobs, controls, or any other type of element that may be triggered, either by a user or automatically in response to some stimuli, for example, from an engagement component, and/or any combination thereof. The reactors may include, but are not limited to, water elements, obstacles, or other structures or device whose operation may be modified based upon triggering of an activator, and/or any combination thereof.

In one embodiment, a water ride may include a body of water, a ride vehicle configured to travel in the body of water, a battery connected with the ride vehicle, an engagement component connected with the ride vehicle and electrically connected with the battery, the engagement component configured to be interacted with by a rider of the ride vehicle, an activator configured to be triggered via the engagement component, and a reactor operatively coupled with the activator, wherein the reactor is configured to produce an effect based upon triggering of the activator.

In another embodiment, a ride vehicle for an amusement attraction may include a body configured to support at least one rider, an engagement component connected with the body and configured to be interacted with by the at least one rider, a battery electrically connected with the engagement component for providing power to the engagement component, and an activator connected with the body, the activator configured to be triggered by a component located outside of the ride vehicle.

In another embodiment, a water ride may include a ride path containing a body of water, a first ride vehicle configured to travel along the ride path in the body of water, a first engagement component connected with the first ride vehicle, a first battery connected with the first ride vehicle for providing power to the first engagement component, a second ride vehicle configured to travel along the ride path in the body of water, a second engagement component connected with the second ride vehicle, a second battery connected with the second ride vehicle for providing power to the second engagement component, a first activator connected with the first ride vehicle and configured to be triggered by the second engagement component of the second ride vehicle, and a second activator connected with the second ride vehicle and configured to be triggered by the first engagement component of the first ride vehicle.

Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further purposes and advantages, will be better understood from the following description when considered in connection with the accompanying figures. It is to be expressly understood, however, that each of the figures is provided for the purposes of illustration and description only and is not intended as a definition of the limits of the present disclosure.

DETAILED DESCRIPTION

Figure 1:
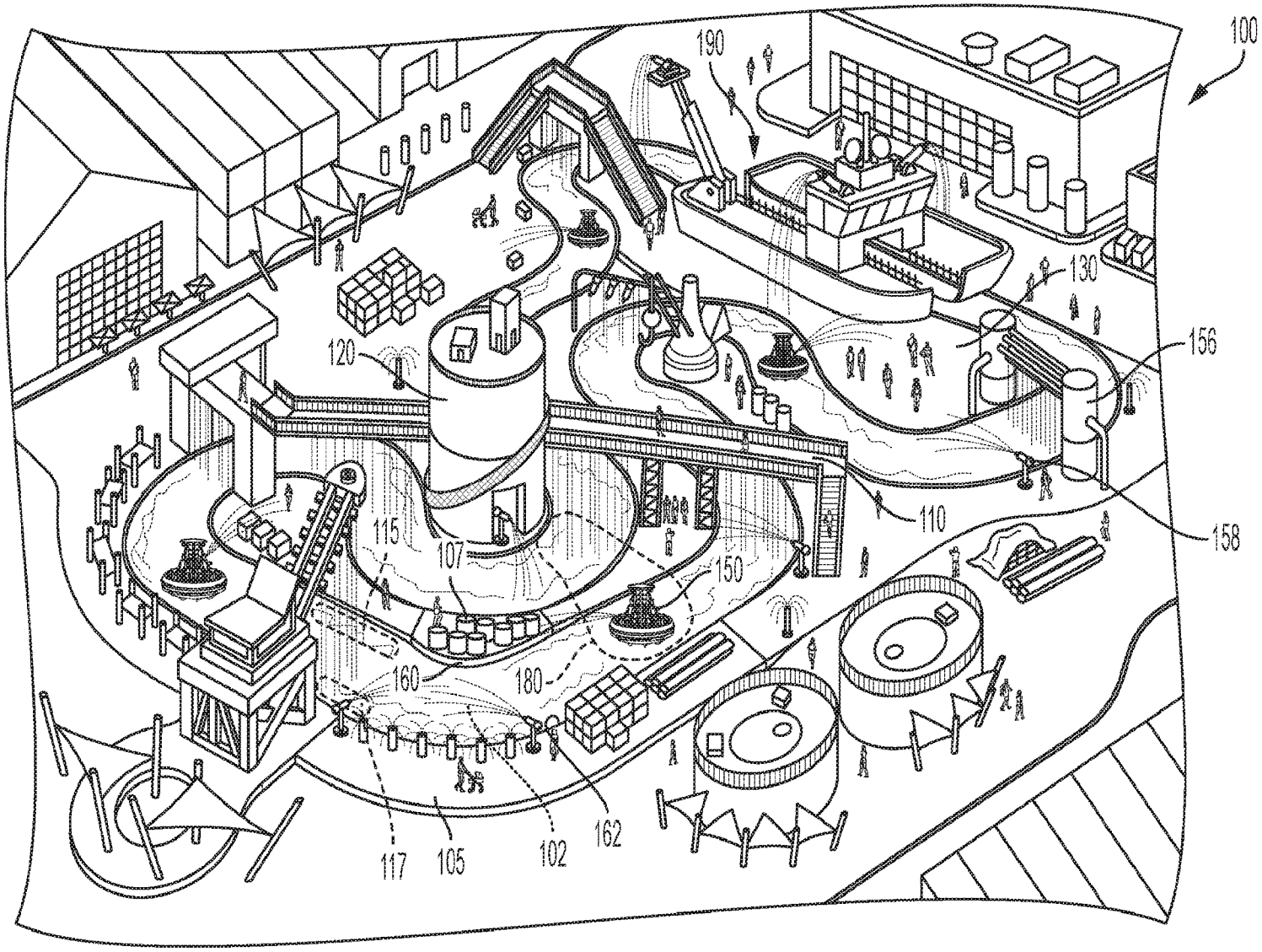
FIG. 1 illustrates an elevated perspective view of a water ride embodying one or more principles of the disclosure, according to one exemplary embodiment of the invention.

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. It will be apparent to those skilled in the art, however, that these concepts may be practiced without these specific details. In some instances, well-known structures and components are shown in block diagram form in order to avoid obscuring such concepts. As described herein, the use of the term "and/or" is intended to represent an "inclusive OR", and the use of the term "or" is intended to represent an "exclusive OR".

The following detailed description illustrates by way of example, not by way of limitation, the principles of the disclosure. This description will clearly enable one skilled in the art to make and use the disclosed embodiments, and describes several embodiments, adaptations, variations, alternatives and uses of the disclosure, including what is presently believed to be the best mode of carrying out the disclosure. It should be understood that the drawings are diagrammatic and schematic representations of exemplary embodiments of the disclosure, and are not limiting of the present embodiments nor are they necessarily drawn to scale.

Exemplary embodiments described herein provide a rider of a ride with engagement devices or components. Engagement devices or components may be any powered or non-powered device that permits the rider to engage with the device or component, for example, to interact with another user or structure, whether it is with a spectator located off of the ride, another rider on the same ride vehicle or another ride vehicle, or the environment of the ride itself or the environment outside of the ride itself. Exemplary embodiments of a system for a ride may include power systems and methods for supplying power to engagement devices or components (or other aspects of a ride vehicle) when the ride vehicle does not have a tethered power supply for providing power. For example, a ride vehicle may be one in which the vehicle is not on a conventional tracked or railed system (e.g., is configured to float and/or manuever in substantially open water, such free-floating along a ride path defined by or within a body of water.

Exemplary embodiments are described with respect to a water ride. However, the features described herein are not so limited. Features and objects described herein may be used with any attraction or park experience, such as non-water rides, attractions, in-line waiting lines, interactive movie and display theaters, or other attraction or environment in which interactive engagement is desired. Exemplary embodiments may be applicable to an environment in which power to a controller or other device or component is limited. For example, in the embodiments described herein, the floating water ride may include certain systems, structures, or elements for providing power as desired to the various equipment of the ride. Other environments may not require the same systems, structures, or elements for providing power and/or may desirably be implemented using alternative power delivery. Exemplary embodiments described herein may be used to retrofit existing or conventional entertainment attractions without requiring renovation for power delivery.

FIG. 1 shows an elevated perspective view of a water ride 100. The water ride 100 includes a ride area 102 that includes a body of water, for example, provided in a circuitous loop or in a predetermined or variable ride path. The ride area 102 may contain water and/or create a free-flowing path for which a ride vehicle 150 may maneuver.

The ride vehicle 150 may float freely on the water within the ride area 102. A station 190 may allow for users to enter and/or exit the ride vehicle 150 and/or to allow for charging or powering of the ride vehicle 150, as discussed in greater detail herein. In an exemplary embodiment, the ride vehicles 150 may be untethered or substantially freely movable within the ride area 102 such that the ride vehicle 150 may not be affixed or directly coupled to a stationary track. Therefore, the ride vehicle 150 may be configured or permitted to change a ride course from one ride experience to the next (e.g., due to the free-flowing nature of the body of water and/or by allowing other control, such as control by riders of the ride vehicle 150 itself, as the ride vehicle 150 traverses the ride area 102).

To help maintain the ride vehicle 150 within the ride area 102, one or more sidewalls (160, 162) may be disposed along all or a portion of a perimeter of the ride area 102 (e.g., on opposing sides). For example, the ride vehicle 150 may be able to move laterally, longitudinally, and/or any combination thereof within the ride area 102, but is prevented from leaving the ride area due to encountering one or more of the sidewalls (160, 162). In one embodiment, the ride vehicle 150 may move due a current of moving water providing by tracks (115, 117) disposed beneath the water of the ride area 102, either at specific locations or along an entirety of the ride area 102 (e.g., along its inner and outer perimeter). In an alternative embodiment, the ride vehicle 150 may move due to one or more propulsion features (e.g., associated with the ride area 102 itself or associated with the ride vehicle 150) to direct the ride vehicle within the ride area 102. The ride vehicle 150 may be able to rotate or otherwise have its movement controlled and/or permitted in the ride area 102. The ride vehicle 150 may be permitted to carry a single rider, or multiple riders, as desired in various embodiments.

The ride vehicle 150 may be any of a variety of possible shapes or configurations as desired. For example, the ride vehicle 150 may have configurations such as, but not limited to, circular, square, rectangular, hexagonal, octagonal, and/or any combination thereof. The ride vehicle 150 may have one or more seats located on an upper surface to support one or more riders therein or thereon. The ride vehicle 150 may be configured to conform to one or more themes or within the park and/or attraction. For example, the ride vehicle 150 may be shaped to resemble a pirate ship, military ship, space ship, truck, race car, mythical creature, dinosaur, wild animal, or fantasy character, super hero, etc. Such configurations may be uniform or varied, as desired by the owner of the attraction. Such configurations may also be constructed (e.g., by users or riders) out of modular components, for example, as disclosed by U.S. Pat. No. 8,850,987.

One or more exemplary spectator locations (105, 107, 130) are located adjacent (e.g., on shores) to the ride area 102. Although only three spectator locations (105, 107, 130) are explicitly identified by reference number in FIG. 1, various spectator locations are shown and/or may be used as desired in varying embodiments of a water ride. Spectator locations may be open areas to allow spectators to stand and/or congregate and/or may be other buildings or facilities (e.g., restaurants, bars, concession stands or structures, walkways, other rides or attractions, etc.). As shown, the ride area 102 may be defined and positioned between shores or walkways in which spectators may locate, travel, or congregate. The shores or walkways may create the spectator locations or separate spectator locations may be included, such as on an overpass or bridge 110, tower 120, landings 130, or any combination thereof. Certain embodiments may include spectator locations on one side and/or both sides of the ride area 102, for example as shown by spectator locations 105 and 107.

The water ride 100 allows for possible interactivity amongst riders on the same or different ride vehicles, spectators watching the water ride 100, or other features of the water ride itself 100. In one embodiment, the ride path may include a switchback 180 such that a rider on the ride vehicle 150 may be in sufficient proximity to other riders on other ride vehicles to use engagement components to interact between different ride vehicles, as discussed in greater detail herein. Exemplary embodiments are also configured such that a rider or ride vehicle may be brought into proximity to other ride vehicles beyond those in adjacent or successive path position (e.g., those vehicles immediately before and after the instant ride vehicle). Therefore, riders may engage with riders on different and varied ride vehicles as well as different spectator locations and/or with adjacent rides or other attractions.

Spectators may interact with the riders through engagement components located at the spectator locations, for example, the engagement component 158, as discussed in greater detail herein. For example, the spectators may spray water towards the ride vehicle 150 as the ride vehicle 150 pass by via the engagement component 158 that operates like a water gun or cannon. In another example, the riders and/or spectators may use engagement components in alternate forms and/or interact (e.g., directly and/or indirectly through the use of an engagement component) with one or more activator that are communicatively coupled with reactors to interact with the riders or others, for example as discussed in greater detail herein. Additionally, riders may use engagement components on the ride vehicles themselves to similarly interact with spectators located off of the ride vehicles, or with other rides on the same ride vehicle or riders on other ride vehicles, as discussed in greater detail herein.

For example, in one embodiment an engagement component for a rider to engage with may be provided on the ride vehicle 150. The engagement component may be any device or component that is configured to change the experience for one or more users (e.g., riders and/or spectators) based upon interaction by one or more users, such as creating visual effects, sound effects, physical effects, movement effects, and combinations thereof. In an exemplary embodiment, the engagement component may be powered. The engagement component may include sensors, transmitters, receivers, input devices, output devices, controllers, and combinations thereof.

One example of an engagement component for the ride vehicle 150 may be a water projectile device that is positioned or connected on the ride vehicle 150 and configured to be controlled by one or more riders of the ride vehicle 150. The water projectile device may be in the form of a weapon, such as a gun or cannon. The water projectile device may be integrated into the form or theme of the raft and may spray water from different water outlets of the ride vehicle 150. The water projectile device may be positionable to accommodate different riders and/or to direct the water projected from the water projectile device at different activators (e.g., targets). The water projectile device may be configured to change a strength of spray (e.g., pressure) to reach different activators. The strength of spray may be determined by the rider by selecting different input features and/or by detection of other transmitters proximate the engagement component and/or by other input signals received. In one embodiment, the operation of a particular engagement component may be modified or manipulated (e.g., turning off the engagement component, changing a characteristic of the engagement component such as reducing its power or rate of fire, etc.). This modification of the operation of an engagement component may be manually directed by a user of the engagement component, automatic (e.g., based upon sensing or determination by a system of the attraction), and/or may be based upon other user activity, for example through the use of activators and/or reactors. For example, if one user engages with a first engagement component to trigger a first activator, the first activator may be communicatively coupled with a reactor that causes a second engagement component to have its operation modified.

In one embodiment, if the ride vehicle 150 is at a portion of the water ride 100 in which different spectator locations are available at a greater distance, such as on the walkway 110 or an upper deck, the engagement component of the ride vehicle 150 may receive a signal from a transmitter on or near the spectator location indicating that additional force is required and/or permitted from the engagement component (e.g., the water projectile device) such that, the rider may hit or spray the water at the spectators at that spectator location. However, if the ride vehicle 150 is at a portion of the ride in which another ride vehicle is within a predetermined or close proximity and/or a spectator location is on an adjacent shore that is determined to be close or within a predetermined distance to the ride vehicle 150, the engagement component may receive a signal that indicates only a lower pressure is permitted. The signal may be received from a transmitter indicating a location of the ride vehicle 150 within the water ride 100 and/or from a transmitter at or near different locations of the water ride 100 that indicate a direction and/or location of the engagement component. The system may also use other and/or additional signals to control the engagement component, such as by determining a direction or orientation of the engagement component, a position within the ride path of the ride vehicle 150 or engagement component, a height of the engagement component, proximity to other objects and/or potential targets, etc. and/or any combinations thereof.

The engagement component may also include a feedback system, such as sounds and/or physical (e.g., haptic) responses of the engagement component. In an exemplary embodiment, the engagement component or other associated system or component may vibrate, move, and/or or change audio queues (e.g., music, sound effects) when another engagement component, such as from another ride vehicle, spectator location, or otherwise, is directed at the engagement component of a ride vehicle 150. Other feedback may be provided such as when another rider or spectator has causes a reactor to respond (e.g., via triggering an activator) within or associated with the ride vehicle 150. For example, a rider of another ride vehicle may hit an activator triggered to simulate an explosion and the associated reactor may play an audio response of an explosion within any ride vehicle that is within a predetermined proximity of the activator.

In one embodiment, an engagement component, may be controlled based on proximity of a rider and/or the ride vehicle 150 to an activator. For example, when the ride vehicle 150 is proximate or determined to be within a predetermined distance from an activator, the activator may detect the ride vehicle 150 and engage its associated reactor. As a specific example, the activator may be a contact or proximity sensor that is activated when a ride vehicle is within a predetermine range or in contact with the sensor. The reactor may be any of a variety of potential reactions, such as a water fall or other water structure 156 that starts or otherwise modifies its behavior based on activation of the activator.

An engagement component may be located on the ride vehicle 150 and/or may be located adjacent to the ride area 102 of the water ride 100, such as on a shore and/or a spectator location. The engagement component may be controlled based on a characteristic of a rider (e.g., the water ride 100 may detect or determine a specific rider attribute, such as height by a position of the engagement component and/or via receipt of an input or signal associated with a particular rider or riders. The engagement component may provide specific responses based on the rider or other input. For example, a rider may accrue points associated with an account. The points may open up additional responses of the engagement component or other engagement components, such as additional pressure for water projectiles, additional reactors including, for example, water structures (e.g., water fountains, water falls, geysers, etc.). The additional responses may include other rider feedback such as in sound effects, haptic responses, control of other rider features (e.g., the ability to limit another rider's ability to shoot). The additional response may include control of the ride vehicle 150, such in making the ride vehicle 150 spin or move faster or slower or change direction.

An available engagement component and/or activator (e.g., target) may be indicated to a user by audio or visual feedback. For example, if a rider of the ride vehicle 150 may activate a reactor, a light on or near the activator associated with the reactor may light up indicating that a rider may trigger the activator associated with the reactor. In an exemplary embodiment, the activator may be a target that is hit by a rider via a water projectile device or other engagement component that may provide response from an associated reactor when the activator is hit. The activator may be "live" or turned on for select durations and/or For select riders. For example, each rider on the ride vehicle 150 may be provided or associated with a color. An activator may be turned on for a specific rider by illuminating a specific color associated with the rider. When the rider hits the activator or otherwise engages the activator, the reactor may be triggered. However, if another rider hits the activator that the activator is not set to or turned on for, then the reactor may not be triggered. Activators may be turned on based on specific rider identify, or may be randomly generated based on the presence of a ride vehicle 150 and in cycling or randomly selecting different riders (such as by selecting different colors associated with different ride positions) within the ride vehicle 150.

As discussed, in one embodiment, an engagement component may include and/or may interface with an activator and an associated reactor that is operatively coupled with the activator. The activator and reactor may be used to control any reaction that engages a user and/or changes/influences the ride experiences such as creating a sound, playing music, vibration or physical response, raft control responses, mechanical responses, chemical responses. For example, the system may be configured to control or create fire levels, explosions, sound effects, haptic responses, water features, creatures or other animation responses, and combinations thereof.

For example, an activator may be a plate, sensor, or button (e.g., located on the ride vehicle 150 that, when triggered a rider (e.g., directly by pressing and/or indirectly by engaging the activator with another engagement component, such as spraying the activator with a stream of water), triggers or causes its operatively coupled reactor to engage in one or more predetermined reactions or activities, either triggered directly or indirectly. For example, triggering an activator may cause a reactor to dump a quantity of water from a particular location, enable a pressurized geyser of water, play a particular sound, etc. In one embodiment, spectators may stand on or at spectator locations while ride vehicles 150 carrying the riders float through the water ride 100 and an activator may trigger a reactor via proximity of the ride vehicle 150 to the reactor, activation by a user or spectator, activation by water, and/or any combination thereof, etc.

Activators and/or reactors may take any of a variety of possible forms and/or may be coupled by any of a variety of possible manners. For example, one or more activators may be coupled to one or more reactors via wireless connection, Bluetooth, wired connections, mechanical connections, etc., and/or any combination thereof. An activator may include, but is not limited to, buttons, switches, knobs, controls, and/or any combination thereof. A reactor may include, but is not limited to, water elements, obstacles, lighting effects, sound effects, haptics, impeders, shakers, motors, motion devices, and/or any combination thereof.

In one embodiment, an activator may be coupled to a reactor that is a water fountain or producer. When the activator is triggered, the water fountain may experience a change in flow. For example, the flow to the water fountain may increase and cause a geyser. The geyser may interact with the riders of the ride vehicle 150, spectators, and/or any combination thereof. Similarly, the water fountain may be any other water feature, such as a shower, water fall, etc. In another embodiment, an activator may be coupled to a reactor that is an impeder. When the activator is triggered, the impeder may prevent one or more water projectiles (such as water weapons described herein on the raft or at a spectator location) from projecting water. In still another embodiment, an activator may be coupled to a reactor that is an audio component for producing a sound effect. When the activator is triggered, the reactor may make a particular sound audible (e.g., via an audio component located on or off of a ride vehicle, such as at a spectator location).

In still another embodiment, an activator may be coupled to reactor that is a visual component for producing a light effect. When the activator is triggered, the reactor may make a particular visual stimuli (e.g., display of a light, flashing of a light, changing of a color, etc., and/or any combination thereof (e.g., via a visual component located on or off of a ride vehicle, such as at a spectator location). In still another embodiment, an activator may be coupled to a reactor that is a shaker (e.g., located on a surface of the ride vehicle and/or on one or more surfaces of a spectator location). When the activator is triggered, the shaker may cause the surface coupled to the shaker to shake or vibrate. In one example, the shaker may be located on or near another engagement component (e.g., a water gun or blaster), as described herein. Accordingly, when triggered, the shaker may cause the engagement component to shake and therefore more difficult to control and/or for providing haptic feedback to the user of the engagement component. Haptic feedback may be triggered by an activator that is either remote to the engagement component or integrated with the engagement component. In another example, the shaker may be integrated or coupled to a rider's seat.

In another embodiment, an activator may be coupled to a reactor that is a motor or other movement device of or associated with a ride vehicle. When triggered, the motor may cause the ride vehicle to move in a direction or rotation. For example, when actuated the activator may make the ride vehicle spin or rotate, for example, to expose different riders on the ride vehicle to different spectator locations. The activator may be positioned on the ride vehicle to permit one or more riders to control a direction of the ride vehicle 150 and/or off of the ride vehicle 150 such as at a spectator location to permit one or more persons off of the raft to control a direction and/or rotation of the ride vehicle. Any combination of engagement components, such as activators and reactors may be simultaneously or sequentially engaged in response to a rider, in response to a position of a ride vehicle, or otherwise, in varying embodiments. A score or other feature that corresponds to one or more particular users (e.g., badges, rewards, benefits, points, etc.) may be accumulated and/or assigned or stored for such users based upon interaction with engagement components and/or activators. For example, a user may be permitted to obtain benefits associated with the water ride 100, or other rides or aspects of the environment (e.g., front-of-line passes, coupons for concessions or souvenirs, etc. based upon interaction with one or more engagement components and/or activators of the water ride 100.

In certain embodiments, power may be needed upon the ride vehicle 150, for example, to deliver power for audio capabilities, video capabilities, movement capabilities, and/or to power one or more components connected with the ride vehicle 150, such as engagement components, activators, reactors, etc. The ride vehicle 150 may be powered by, but not limited to, battery, electrical, induction, electro-magnetic, or any combination thereof. Exemplary embodiments of the invention include ride vehicles in which the ride vehicles do not receive power through conventional track/tethered power. Powering one or more of the engagement components, activators, reactors, or other systems requires providing and/or storing power on a ride vehicle that may be traversing a free-floating, trackless water ride.

AC power may be used and/or DC power may be used (e.g., 12 Vdc). In one embodiment, as discussed, the ride vehicle 150 may include a battery in order to support power upon a water ride that utilizes free-floating and/or trackless traversal by the ride vehicle 150. The battery may power the ride vehicle 150 and/or any other features or engagement components, activators, and/or reactors associated with the ride vehicle 150. For example, if the ride vehicle 150 includes an engagement component in the form of a water projecting blaster, the blaster may be pump driven via power from the battery for increasing range, volume, or reducing rider fatigue by replacing hand crank or rider generated pressure.

The battery of the ride vehicle 150 may be rechargeable and/or replaceable. The battery may be any of a variety of types, including Li-Ion, LFP, Sealed Deep Cycle Lead Acid, NiCd, NiMh, etc. In exemplary embodiments, the batteries may be charged by methods such as, but not limited to, a power station, a beanpole, or any combination thereof. For example, the ride vehicle 150 may be configured to charge as it passes through the station 190 (e.g., an entrance/exit station for riders) in order to top up the battery as much as possible and/or extend operational use. In the water ride 100 where the ride vehicle 150 may not enter the station 190 in the same orientation (e.g., may be rotated by some degree between sequential visits to the station), an orientation-agnostic approach may be taken to charge the battery. In one example, a three-point pickup system may be used with power pickup points (e.g., conductive pads or plates) located every 120 degrees under the ride vehicle 150 (e.g., located substantially in a ring around a perimeter on a bottom surface of the ride vehicle 150). The station 190 may include two charging plates or rails (– and +) over the length of all or a portion of the station 190. Accordingly, as the ride vehicle 150 enters the station 190 and travels over the two charging plates or rails, no matter the orientation of the ride vehicle 150, at least one pickup of the ride vehicle 150 will be in contact with the (+) pole and at least one other pickup will be in contact with the (−) pole. In certain embodiments, inductive charging may be used. In still another embodiment, solar energy may be used for recharging batteries.

In one embodiment, the ride vehicle 150 may be removed from the ride area 102 and enter a storage, overnight, or maintenance structure (e.g., a portion of the station 190 and/or a different structure). The structure may include a conveyor such that the ride vehicle 150 is on a tracked path and/or removed from the water. The ride vehicle 150 may be charged when at the structure and/or out of the water. After closing of the water ride 100 at an end of a day or at some time during the day, the ride vehicle 150 may be engaged with a wired power cable. The ride vehicle 150 may be stored in a docking or charging section of the water ride 100 and/or a power station may be provided to the ride vehicle 150 as it is secured or retained in the water ride 100. The ride vehicle 150 may therefore be configured with a receiving plug port to charge the battery. The battery (or plurality of batteries) may be of sufficient size to provide power for a desired duration of use, such as a full day's activities. In an exemplary embodiment, overnight charging may be used to provide substantial or all of recharge to the battery, and supplemental charging may be provided during the day's use according to other embodiments described herein. For example, in-ride charging may be used to keep power levels above a certain threshold.

In an exemplary embodiment, the ride vehicle 150 may be charged by a system integrated with a docking and/or conveyor system of the water ride 100. For example, a pole may extend from the ride vehicle 150 (e.g., from a center column of the ride vehicle 150) and engage an overhead power transmission line or other connectivity interface. Power transfer may be quick and stored in the battery of the ride vehicle 150. The power transfer may be used to help keep the battery at peak capacity. Exemplary embodiments may configure the docking and/or conveyor system to be in-line with the ride path such as for entrance/exit of passengers to and from the ride vehicle 150. Therefore, the battery may be configured to maintain sufficient power during an individual ride cycle and recharge between ride cycles. Other engagement/charging features may be used, such as other charging interfaces beyond the pole/extension from the ride vehicle 150.

In an exemplary embodiment, the battery may be removable from the ride vehicle 150. For example, a rider may be provided an individual battery pack, such as when they are in a queue and/or that may be kept by the user. Upon entering the ride vehicle 150, the user may place their battery pack (e.g., which may be configured or shaped to correspond to ride story features, such as an amulet, etc.) within a receptacle at a respective station of the water ride 100 and/or another designated location on the ride vehicle 150. The battery pack may provide sufficient power to support features and effects for the ride cycle with the rider. The battery pack may be removed by the rider and recharged (and/or may be used to track usage and/or detect/identify users between rides). The rider may thereafter recharge their battery pack such as when waiting in line for the ride and/or at a charging station. The rider (and/or attendant to the ride) may also remove the depleted battery and deposit it in a bin or other receptacle that can be removed and an attendant and recharge the batteries and reuse for different riders. A raft docking station may be provided with a power station in order to charge the battery (e.g., a power station may be located on a shore of the water ride 100).

Although various exemplary embodiments described herein are generally in the context of water related engagement features, various other types of engagement components, activators, reactors, etc. may be used in addition and/or alternatively to water responses and are not so limited. For example, an engagement component may be a laser gun that use light or infrared to trigger targets. Other devices may be buttons, switches, inferred (IR) transmitters, Bluetooth, Wi-Fi, Near Field communication (NFC), radio frequency (RF), or other transmitter. Other activators may be input sensors such as pressure sensors, proximity sensor, IR receiver, Bluetooth, Wi-Fi, RF, NFC, or other receiver. Different combinations of transmitters and receivers may be used including audial, visual/optical/light, etc.

Figure 2B:
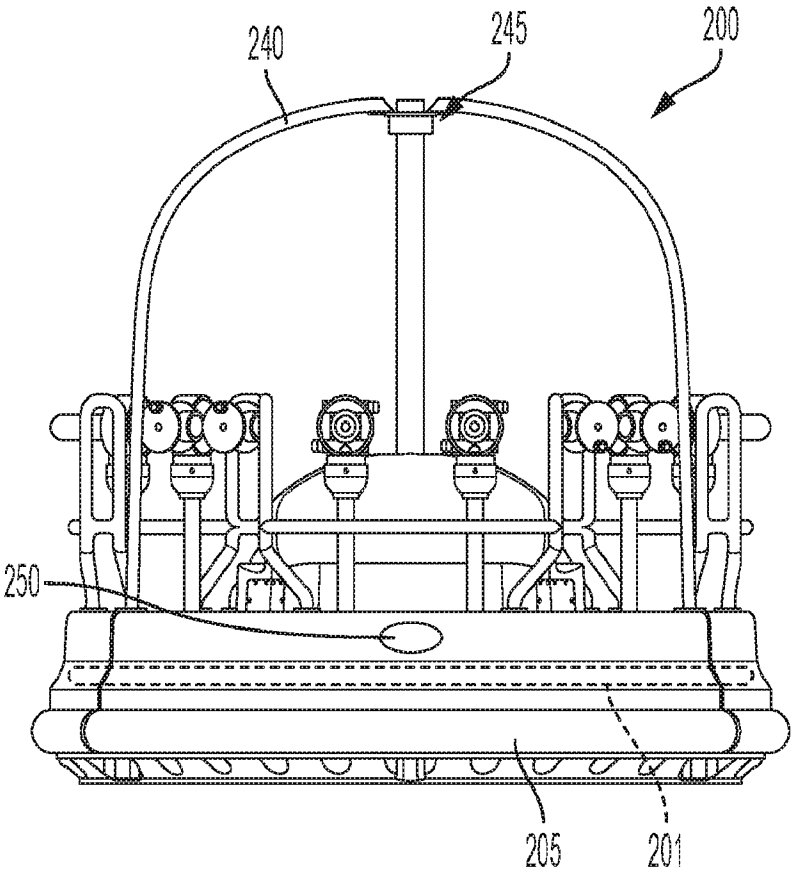
FIG. 2B illustrates a side view of the ride vehicle of FIG. 2A, according to one exemplary embodiment of the invention.
Figure 2A:
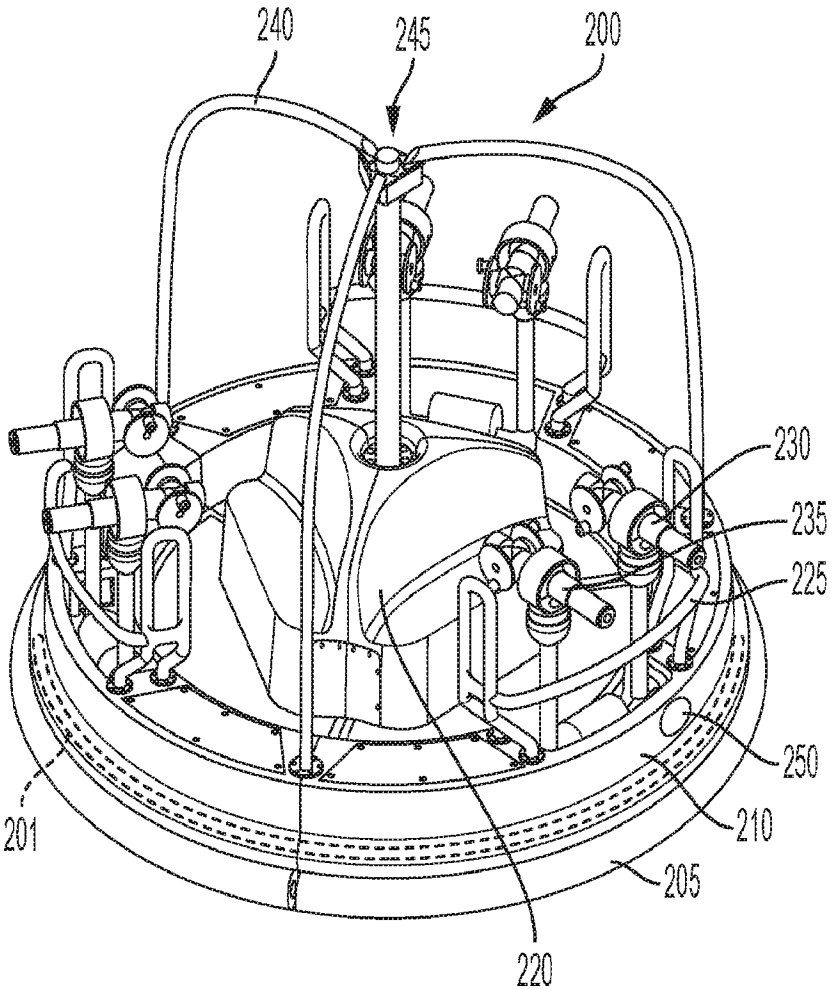
FIG. 2A illustrates a perspective view of a ride vehicle embodying one or more principles of the disclosure, according to one exemplary embodiment, of the invention.

FIGS. 2A and 2B shows a perspective view and a side view, respectively, of a ride vehicle 200. The ride vehicle 200 may include features the same as or similar to those discussed throughout. For example, the ride vehicle 200 may be configured to travel within a body of water of a water attraction and permit interactivity between users of the ride vehicle 200, users of a different ride vehicle, users or the environment outside of the water ride, and/or spectators to the water attraction. The ride vehicle 200 includes a base 210 and a bumper or other element 205 connected with the base 210 and disposed along an outside of the base 210 and configured to make impact (e.g., with a sidewall of the water attraction) should the ride vehicle 200 get too close to a boundary of the water attraction. The bumper 205 may help prevent damage and/or wear-and-tear to the structure of the ride vehicle 200 due to impact with sidewalls of the water attraction during operation. A frame 240 may provide a structure for riders to grab when entering, exiting, or otherwise moving around upon the ride vehicle 200 and/or for support for other components of the ride vehicle 200. In certain embodiments, the frame 240 may additionally or alternatively provide stability and/or balance to the ride vehicle 200.

The ride vehicle 200 includes one or more engagement components (230, 235) connected therewith. The engagement components (230, 235) may be engaged or interacted with by one or more users of the ride vehicle 200 to cause an effect, such as a stream or projectile (e.g., fluid, such as water). A railing or other structure 225 may be connected with or adjacent to the one or more engagement components (230, 235). The engagement components (230, 235) may be controlled manually (e.g., by a rider) and/or may be controlled remotely and/or automatically (e.g., by a controller or other electronic system or trigger of the water ride). In the exemplary embodiment shown in FIGS. 2A-2B, the engagement components (230, 235) may be a component for dispersing water based upon interaction with an element, such as a trigger, button, switch, lever, pump, crank, and/or other input device, etc. The engagement components (230, 235) may be configured to project water away from an interior of the ride vehicle 200. Other engagement components not located on the ride vehicle 200, but rather on the shores, as discussed in greater detail herein, may be configured to project water toward the water ride and/or ride vehicle 200 during operation. Any of a variety of possible engagement components may be used in alternative embodiments, such as water guns, blasters, barrels, cannons, spouts, outlets, etc. that are mounted to the ride vehicle 200 and/or integrated into one or more materials making up the construction of the ride vehicle 200 itself.

In one embodiment, the engagement components (230, 235) may be adjustable such that a user is permitted to define a direction for output (e.g., by rotating or moving all or a portion of the engagement components (230, 235)) and/or an amount of output (e.g., by pumping or "charging" the engagement component (230, 235) for a particular period time or number of repetitions). Other aspects of the engagement components (230, 235) may be adjusted in certain embodiments. For example, an adjustment mechanism may allow a height of the engagement components (230, 235) or some portion of the engagement components (230, 235) to be set and/or positioned (e.g., dynamically) for an individual user and/or for a specific target. For example, a rider of lesser height may be able to use an adjustment mechanism to move a trigger or other interactive element for causing an action of the one or more engagement components (230, 235) down or a rider of greater height may be able to use an adjustment mechanism to move a trigger up. As such, the adjustment mechanisms may allow the engagement components (230, 235) output to accommodate users and/or spectators of various heights. The engagement components (230, 235) may be powered by manual means (e.g., a user may engage with a pump or other manual interface in order to pressurize water or other fluid for subsequent dispersal from the engagement components (230, 235). In an alternative embodiment, the engagement components (230, 235) may be powered (e.g., fully or partially) by electrical power.

The ride vehicle 200 includes one or more seats 220 for supporting one or more riders therein or thereon. In one embodiment, the one or more seats 220 are positioned at an interior of the ride vehicle 200 (e.g., at or near its center) and/or are directed or faced outward toward an exterior of the ride vehicle 200. The seats 220 may be in any position and/or support any number of participants in alternative embodiments. As specifically shown in FIGS. 2A-2B, the one or more seats 220 may be positioned in pairs and/or such that multiple riders can fit on a single surface. The pairs or any combination of seats 220 may be used to create teams (e.g., competitive against and/or cooperative with other teams) within the ride vehicle 200 or across different ride vehicles in one embodiment. For example, the one or more engagement components (230, 235) may be configured to track points as riders engage different activators of the water ride, as previously discussed. Each team or rider may play against the others receiving points for each successful engagement. Teams may also be used to facilitate other features. For example, engagement features may be unlocked based on recognition of a team and/or upon performance of an individual and/or team within the ride.

The ride vehicle 200 may include lighting or lighting elements or areas 201. The lighting may be, but is not limited to, light emitting diodes, light bulbs, strobe lights, and/or any combination thereof. In one example, a continuous ring of lighting may be connected around a perimeter of the ride vehicle (e.g., around the base 210). In another example, discrete lights may be spread (e.g., evenly distributed) around a perimeter of the ride vehicle. Any of a variety of possible lighting elements (e.g., light emitting diode, strips, spots, etc.) may be used as accent lighting or otherwise to provide illumination on or for the ride vehicle 200. In certain embodiments, elements or components configured to be interacted with by a user may be illuminated (e.g., via an outside light source shining light upon the element or component and/or the element or component may have lighting integrated within it, such as a button that is backlit).

The ride vehicle 200 may include speakers or other audio components 245. The speakers or other audio components may be, but are not limited to, auditory equipment such as amplifiers, wired speakers, wireless speakers, subwoofers, and/or any combination thereof. In one embodiment, one or more of the speakers or other audio components may be water resistant and/or housed within a water resistant enclosure. In one embodiment, one or more of the speakers or other audio components may be UV resistant and/or housed within a UV resistant enclosure. As shown, the speakers or other audio components 245 may be located near a top of the ride vehicle 200 (e.g., connected with the frame 240). In another embodiment, the speakers or other audio components 245 may be alternatively located, for example close to the ears of riders, such as within or near the seats 220.

The ride vehicle 200 may be configured to have its movement independently controlled, for example, beyond merely floating along a body of water or whose movement is entirely determined by movement features associated with the water ride itself rather than the ride vehicle (e.g., conveyors, jets, etc. associated with the water ride). In one example, the ride vehicle 200 may have one or more motors associated therewith. Accordingly, the motor may be configured to move the ride vehicle 200 along the water ride and/or may change direction or impose a rotation of the ride vehicle 200 during operation, for example, due to some interaction by one or more riders.

Figure 3:
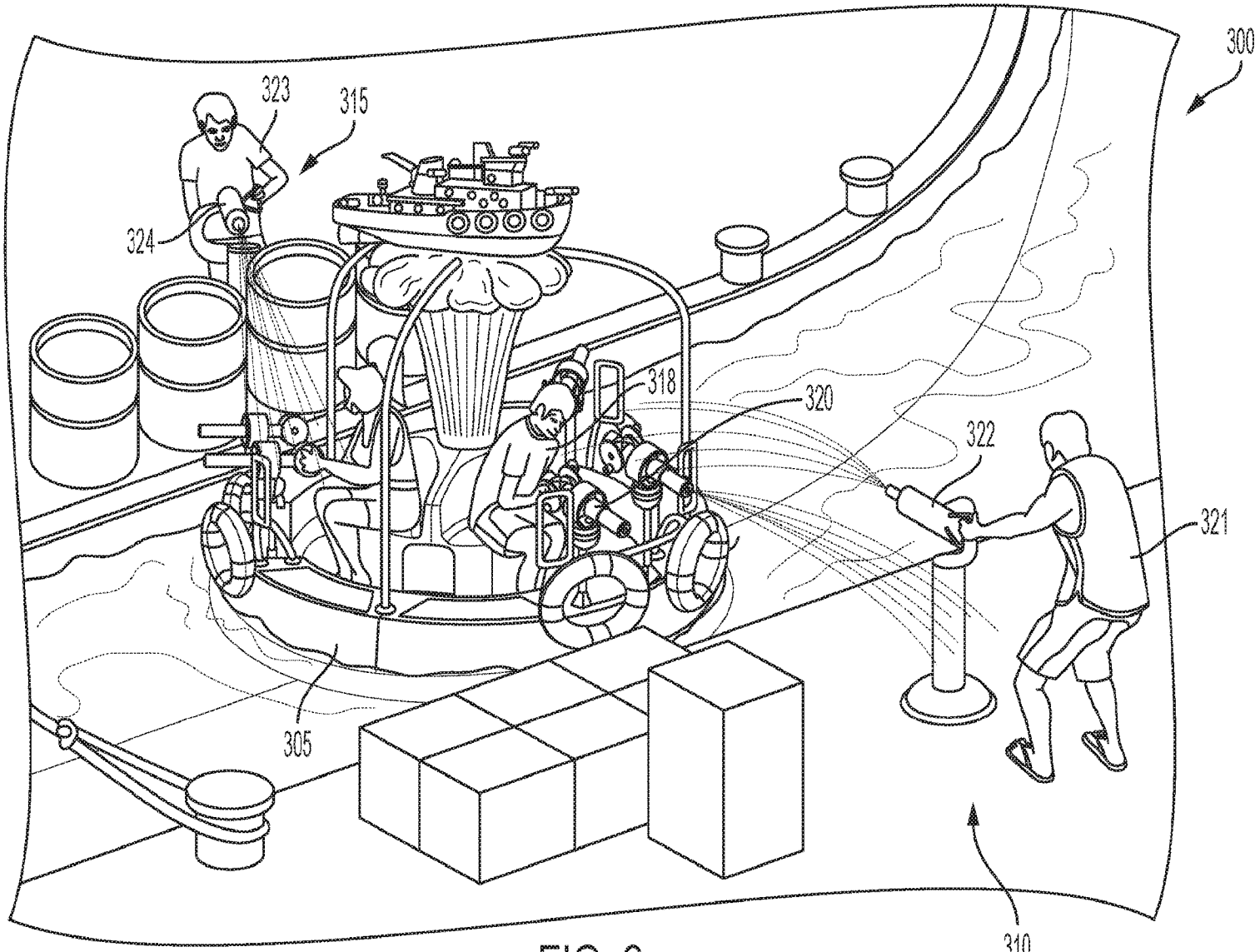
FIG. 3 illustrates a portion of a water ride for allowing interactivity between users on a ride vehicle and spectators of the ride vehicle, embodying one or more principles of the disclosure, according to one exemplary embodiment of the invention.

As discussed, certain embodiments may allow users of ride vehicles of a water ride to interact with spectators to that water ride. As shown in FIG. 3, a portion of a water ride 300 is shown that has a ride path (e.g., a body of water) that brings a ride vehicle 305 within interactive proximity to a first spectator area 310 and a second spectator area 315. Each of the ride vehicle 305, the first spectator area 310, and the second spectator area 315 may include engagement components (320, 322, 324, respectively), such as water guns, that allow rider(s) 318 of the ride vehicle 305 and spectators (321, 323) at the spectator area 310 and the spectator area 315 to interact with one another by engaging with the engagement components (320, 322, 324) and to cause an effect of the engagement components (320, 322, 324) as desired (e.g., aiming a spray of water as shown). For example, riders of the ride vehicle 305 may interact (e.g., via buttons, triggers, cranks, knobs, etc.) with the engagement component (e.g., a water gun or cannon) 320 of the ride vehicle 305 to direct an effect at one and/or both the first spectator area 310 and the second spectator area 315. Likewise, a spectator at the first spectator area 310 may similarly interact (e.g., via buttons, triggers, cranks, knobs, etc.) with the engagement component (e.g., a water gun or cannon) 322 of the first spectator area to direct an effect at the ride vehicle 305. Similarly, a spectator at the second spectator area 315 may similarly interact (e.g., via buttons, triggers, cranks, knobs, etc.) with the engagement component (e.g., a wafer gun or cannon) 324 of the second spectator area 315 to direct an effect at the ride vehicle 305. In certain embodiments, spectators may cause interactions to occur not only with riders upon the water ride 300, but also at other spectators.

Similarly, in addition to or alternative to the engagement components (320, 322, 324), riders of the ride vehicle 305, the first spectator area 310, and/or the second spectator area 315 may interact with activators (e.g., buttons, triggers, cranks, knobs) that, when interacted with, cause an effect via reactors that are operatively coupled or triggered by activation of one or more activators. The reactor may be a device, component, or set of components that cannot be otherwise manipulated by a rider (e.g., aimed or directed or otherwise controlled) except via triggering from the activator. For example, when an activator associated with the ride vehicle 305 (e.g., one or more targets located on the ride vehicle 305), first spectator area 310, and/or second spectator area 315 is triggered by one or more users, one or more reactors operatively coupled to the respective activators may interact with the riders of the ride vehicle 305 and/or spectators at the first spectator area 310, and/or second spectator area 315 or individuals elsewhere as desired.

Figure 4:
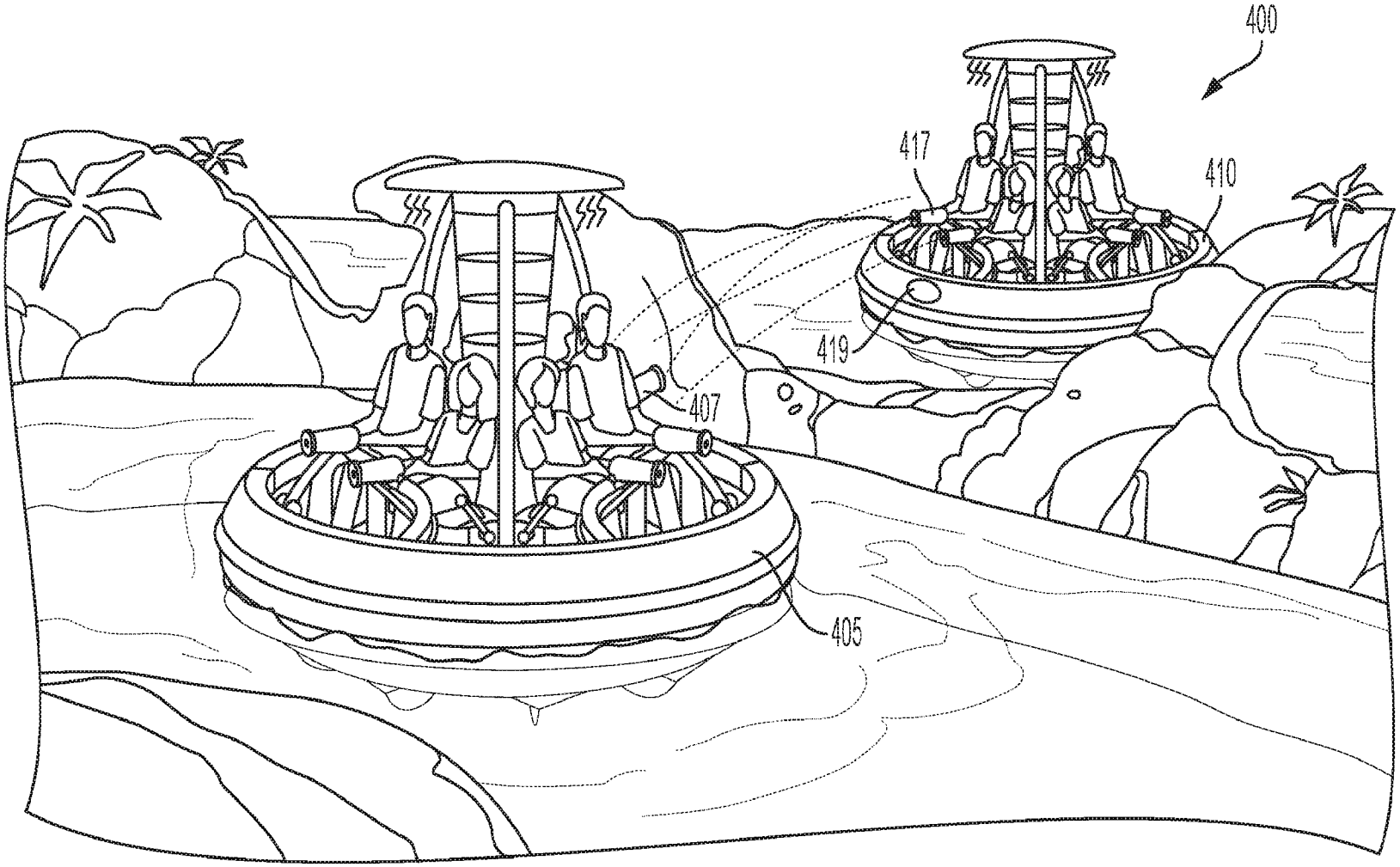
FIG. 4 illustrates a portion of a water ride allowing interactivity between users on a first ride vehicle and users on a second ride vehicle, embodying one or more principles of the disclosure, according to one exemplary embodiment of the invention.

As discussed, certain embodiments may allow users in different ride vehicles of a water ride to interact with one another while traveling along or on the water ride. As shown in FIG. 4, a portion of a water ride 400 is shown that has a ride path (e.g., a body of water) that brings a first ride vehicle 405 within interactive proximity to a second ride vehicle 410. The first and second ride vehicles (405, 410) include engagement components (407, 417), such as water guns, that allow one or more riders of each ride vehicle (405, 410) to interact with one another by engaging with the engagement components (407, 417) and directing or causing an effect of the engagement components (407, 417) (e.g., aiming a spray of water as shown). For example, riders of the first ride vehicle 405 may interact (e.g., via buttons, triggers, cranks, knobs, etc.) with the engagement component (e.g., a water gun or cannon) 407 of the first ride vehicle 405 to direct an effect at the second ride vehicle 410. Likewise, riders of the second ride vehicle 410 may similarly interact (e.g., via buttons, triggers, cranks, knobs, etc.) with the engagement component (e.g., a water gun or cannon) 417 of the second ride vehicle 410 to direct an effect at the first ride vehicle 405.

Similarly, in addition to or alternative to the engagement components (407, 417), riders of the first ride vehicle 405 and/or the second ride vehicle 410 may trigger activators (409, 419) (e.g., buttons, triggers, cranks, knobs) that, when triggered with, cause an effect via reactors that are operatively coupled or triggered by activation of one or more activators. The reactor may be a device, component, or set of components that cannot be otherwise manipulated by a rider (e.g., aimed or directed or otherwise controlled) except via triggering from the activator. For example, when an activator 419 associated with the second ride vehicle 410 is manipulated by one or more riders of the second ride vehicle 410 and/or engaged with by a rider of the first ride vehicle 405 (e.g., spraying or effecting the activator 419 via the engagement component 407, one or more reactors operatively coupled to the activator 419 may interact with the riders of the first ride vehicle 405, second ride vehicle 410, or otherwise.

Figure 5:
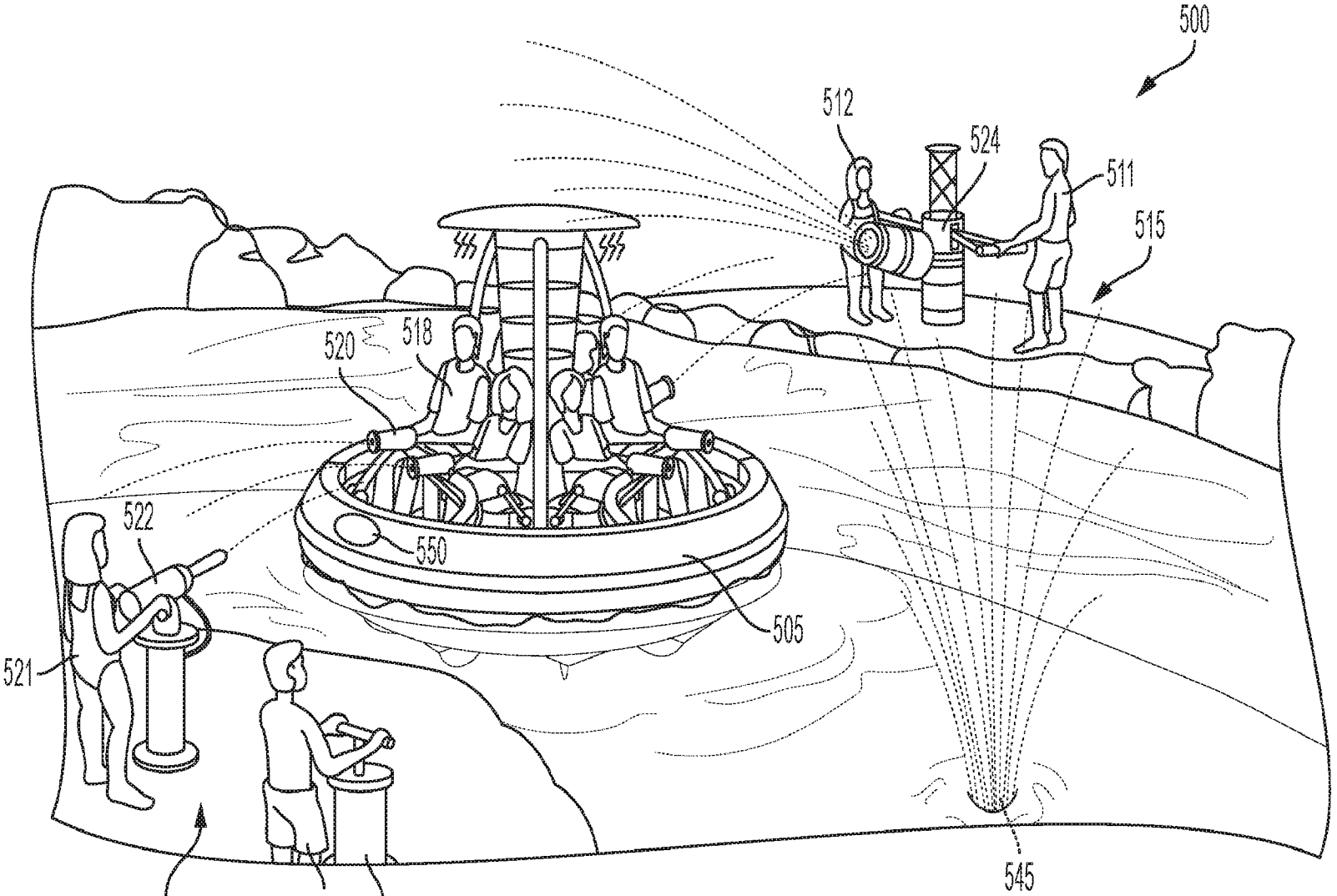
FIG. 5 illustrates a portion of a water ride allowing interactivity between users on a ride vehicle and spectators of the ride vehicle, embodying one or more principles of the disclosure, according to one exemplary embodiment of the invention.

As discussed, certain embodiments may allow users of ride vehicles of a water ride to interact with spectators to that water ride. As shown in FIG. 5, a portion of a water ride 500 is shown that has a ride path (e.g., a body of water) that brings a ride vehicle 505 within interactive proximity to a first spectator area 510 and a second spectator area 515. Each of the ride vehicle 505, the first spectator area 510, and the second spectator area 515 may include engagement components (520, 522, 540, 524), such as water guns or cannons, that allow riders of the ride vehicle 505 and spectators (521, 539) at the first spectator area 510 and spectators (511, 512) at the second spectator area 515 to interact with one another by engaging with the engagement components (520, 522, 540 524) and directing the effect of the engagement components (520, 522, 540, 524) as desired (e.g., aiming a spray or output of water as shown). For example, riders of the ride vehicle 505 may interact (e.g., via buttons, triggers, cranks, knobs, etc.) with the engagement component (e.g., a water gun or cannon) 520 of the ride vehicle 505 to direct an effect at one and/or both the first, spectator area 510 and the second spectator area 515. Likewise, a spectator 521 at the first spectator area 510 may similarly interact (e.g., via buttons, triggers, cranks, knobs, etc.) with the engagement component (e.g., a water gun or cannon) 522 of the first spectator area to direct an effect at the ride vehicle 505. A spectator 539 at the first spectator area 510 may similarly interact (e.g., via buttons, triggers, cranks, knobs, etc.) with the engagement component 540 of the first spectator area 510 to cause an effect 545 within the body of water (e.g., manipulation of the engagement component 540 may trigger an explosion or output of pressurized water or geyser to erupt at one or more predetermined locations in the body of water, such as near the ride vehicle 505). Similarly, one or more spectators (511, 512) at the second spectator area 515 may similarly interact, cooperatively, competitively, or independent of one another (e.g., via buttons, triggers, cranks, knobs, etc.) with the engagement component (e.g., a water gun or cannon) 524 of the second spectator area 515 to direct an effect at the ride vehicle 505. In certain embodiments, spectators may cause interactions to occur not only with riders upon the water ride 500, but also at other spectators. As previously discussed, any of a variety of activators and/or associated reactor may be placed on the ride vehicle 505 (such as an activator 550), at the spectator areas (510, 515), and/or elsewhere for use.

Although specific engagement components, activators, and reactors have been described throughout this specification and specifically illustrated, any of a variety of possible other elements, components, or sets of components may be used in alternative embodiments. For example, other possible engagement components may be blasters or cannons that shoot projectiles, such as foam balls, bubbles, air, or any of a variety of potential items when aimed by a user. Likewise, activators may consist of buttons, cranks, switches, dials, microphones, video cameras, etc. or any type of device or element capable of being interacted with by a user. Accordingly, reactors may be any of a variety of potential devices or set of devices so long as their activity is capable of being triggered by the activator, such as waterfalls, dumping buckets, pressurized fluid (e.g., air, water), release of chemicals, such as smells, etc.

Exemplary embodiments may include ride vehicle tracking such that the reactors and/or responses within the system may be based on location of a ride vehicle. Reactors and/or responses may be based on an orientation of the ride vehicle. Reactors and/or responses may be based on a proximity of the ride vehicle to another portion of the ride, ride path, and/or another ride vehicle, etc.

Tracking of ride vehicles may be determined by a variety of possible means. For example, an optical signal may be used for simple tracking of when a ride vehicle enters and/or exits a given area or zone. More advanced tracking (e.g., identification of a particular ride vehicle and/or rider within an area) may be performed via Radio Frequency Identification ("RFID") or other unique identification signals. In one embodiment, setup of a localized network (e.g., Wi-Fi network, meshed network, etc.) may be used to allow ride vehicles to communicate with one another and/or with other devices located throughout the water ride.

In one embodiment, as discussed, an engagement component (e.g., a gun or projectile device) may be configured to shoot at an activator (e.g., a target) to trigger a response from a corresponding reactor. If no identification is needed, an optical signal from the engagement component to the activator (e.g., capable of receiving and/or further distinguishing or making determinations about the signal) may be used to trigger the reactor. In certain embodiments, tracking of particular interactions by particular users and/or engagement components may be desired. For example, if an identification of which individual triggered a particular reactor may incorporate engagement components having unique signals and an activator capable of receiving and distinguishing between such signals. Once the activator is triggered, a further determination may be made to determine if the desired individual triggered the activator via analysis of the unique signal received.

Although the disclosure has been described above with specific reference to various embodiments and examples, it should be understood that various additions, modifications, deletions and alterations may be made to such embodiments without departing from the spirit or scope of the disclosure. Accordingly, it is intended that all reasonably foreseeable additions, deletions, alterations and modifications be included within the scope of the disclosure as defined in the following claims. When used in this specification and claims, the terms "comprises" and "comprising" and variations thereof mean that the specified features, steps or integers are included. The terms are not to be interpreted to exclude the presence of other features, steps or components.

Although embodiments of this invention have been fully described with reference to the accompanying drawings, it is to be noted that various changes and modifications will become apparent to those skilled in the art. Such changes and modifications are to be understood as being included within the scope of embodiments of this invention as defined by the appended claims. Specifically, exemplary components are described herein. Any combination of these components may be used in any combination. For example, any component, feature, step or part may be integrated, separated, sub-divided, removed, duplicated, added, or used in any combination and remain within the scope of the present disclosure. Embodiments are exemplary only, and provide an illustrative combination of features, but are not limited thereto.

The invention claimed is:

1. An amusement ride, comprising:

a ride area;

a first ride vehicle configured to travel from a first location to a second location laterally offset from the first location within the ride area;

a second ride vehicle configured to travel from a third location to a fourth location laterally offset from the third location within the ride area;

a first activator connected with the first ride vehicle, the first activator configured to be interacted with by a rider of the first ride vehicle;

a first reactor operatively coupled with the first activator, wherein the first reactor is disposed on the second ride vehicle and is configured to produce a first effect in the second ride vehicle based upon triggering of the first activator;

a second activator connected with the second ride vehicle, the second activator configured to be interacted with by a rider of the second ride vehicle; and a second reactor operatively coupled with the second activator, wherein the second reactor is configured to produce a second effect in the first ride vehicle based upon triggering of the second activator.

2. The amusement ride of claim 1, wherein the first activator is configured to be triggered by direct contact between the rider of the first vehicle and the first activator.

3. The amusement ride of claim 1, further comprising a spectator engagement component at a spectator area adjacent to and outside the ride area, the spectator engagement component configured to be interacted with by a spectator.

4. The amusement ride of claim 3, wherein the first activator cannot be triggered by the spectator engagement component.

5. The amusement ride of claim 3, wherein the first effect of the first reactor includes an amount of water being provided to the spectator area.

6. The amusement ride of claim 3, wherein the first effect of the first reactor includes modifying operation of the spectator engagement component.

7. The amusement ride of claim 3, further comprising:

a third activator connected with the first ride vehicle, the third activator configured to be interacted with by the spectator engagement component; and a third reactor operatively coupled with the third activator, wherein the third reactor is configured to produce a third effect in the first ride vehicle based upon triggering of the third activator.

8. The amusement ride of claim 1, wherein the ride area is filled with water and the first and second ride vehicles are configured to move through the water filling the ride area due to a current of moving water within the ride area.

9. The amusement ride of claim 1, wherein the ride area is filled with water and the first and second ride vehicles are configured to float freely on the water filling the ride area.

10. An amusement ride, comprising:

a ride area;

a first ride vehicle configured to travel from a first location to a second location laterally offset from the first location within in the ride area;

a second ride vehicle configured to travel from a third location to a fourth location laterally offset from the third location within the ride area;

a first activator connected with the first ride vehicle and configured to be interacted with by a rider of the first ride vehicle;

a first reactor operatively coupled with the first activator, wherein the first reactor is disposed on the second ride vehicle and is configured to produce a first effect in the second ride vehicle based upon triggering of the first activator;

a second activator connected with the second ride vehicle and configured to be interacted with by a rider of the second ride vehicle; and a second reactor operatively coupled with the second activator, wherein the second reactor is configured to produce a second effect based upon triggering of the second activator component.

11. The amusement ride of claim 10, wherein the first activator is configured to be triggered by direct contact between the rider of the first ride vehicle and the first activator.

12. The amusement ride of claim 10, wherein the first effect produced by the first reactor is configured to change based on receipt of an input feature.

13. The amusement ride of claim 10, wherein the first effect of the first reactor includes an amount of water being provided to the second ride.

14. The amusement ride of claim 10, further comprising a spectator engagement component at a spectator area adjacent to and outside of the ride area, the spectator engagement component configured to be interacted with by a spectator of the first ride vehicle who is located within the spectator area.

15. The amusement ride of claim 14, wherein the first activator cannot be triggered by the spectator engagement component.

16. The amusement ride of claim 14, wherein a second effect of the first reactor includes modifying operation of the spectator engagement component.

17. The amusement ride of claim 14, further comprising:

a third activator connected with the first ride vehicle, the third activator configured to be interacted with by the spectator engagement component; and a third reactor operatively coupled with the third activator, wherein the third reactor is configured to produce a third effect based upon triggering of the third activator;

wherein the third reactor produces the third effect in the first ride vehicle.

18. An amusement ride, comprising:

a ride area;

a first ride vehicle configured to travel from a first location to a second location laterally offset from the first location in the ride area;

a second ride vehicle configured to travel from a third location to a fourth location laterally offset from the third location within the ride area;

a first activator component located adjacent the ride area, the first activator component configured to be interacted with by a rider of the first ride vehicle; and a first reactor operatively coupled with the first activator component, wherein the first reactor is disposed on the second ride vehicle and is configured to produce a first effect based upon triggering of the first activator component;

wherein the first reactor produces the first effect in the second ride vehicle.

19. The amusement ride of claim 18, wherein the first activator comprises a microphone configured to be triggered by the rider of the first ride vehicle producing a sound that is detected by the microphone.

20. The amusement ride of claim 18, wherein the first activator comprises a camera configured to be triggered by the rider of the first ride vehicle making a gesture that is detected by the camera.

* * * * *